US005237726A

United States Patent [19]

Gartenmann et al.

[11] Patent Number: 5,237,726

[45] Date of Patent: Aug. 24, 1993

[54] METHOD AND APPARATUS FOR FILLING TEXTILE MATERIAL INTO CONTAINERS HAVING AN ELONGATE CROSS SECTION

[75] Inventors: Niklaus Gartenmann, Winterthur; Hugo Biberstein, Stadel; Marcel Siegenthaler, Effretikon, all of Switzerland

[73] Assignee: Maschinenfabrik Rieter AG, Winterthur, Switzerland

[21] Appl. No.: 701,857

[22] Filed: May 17, 1991

[30] Foreign Application Priority Data

May 18, 1990 [CH] Switzerland ..... 01688/90

[51] Int. Cl.[5] ..... D01G 27/00; B65H 67/00

[52] U.S. Cl. ..... 19/159 R; 19/159 A

[58] Field of Search ..... 19/150, 159 R, 159 A; 57/90, 265, 266, 276, 281, 268; 414/788, 222; 198/339.1, 736; 100/82, 83, 84, 85

[56] References Cited

U.S. PATENT DOCUMENTS

| | | | |
|---|---|---|---|
| 2,546,557 | 3/1951 | Naegli | 19/159 R |
| 3,233,290 | 2/1966 | Defore | 19/159 R |
| 3,323,179 | 6/1967 | Gossett et al. | 19/159 R |
| 3,339,244 | 9/1977 | Van Deusen | 19/159 R |
| 3,353,224 | 11/1967 | Gossett et al. | 19/159 R |
| 3,426,390 | 2/1969 | Whitehurst | 19/159 R |
| 3,429,009 | 2/1969 | Goodner | 19/159 R |
| 3,614,814 | 10/1969 | Araki et al. | 19/159 R |
| 3,808,641 | 5/1974 | Schneider et al. | 19/159 A |
| 3,848,297 | 11/1974 | Ohashi et al. | 19/159 R |
| 4,033,104 | 7/1977 | Kamp | 57/90 X |
| 4,150,534 | 4/1979 | Raasch | 19/159 A X |
| 4,290,169 | 9/1981 | Vignon | 19/159 R |
| 4,683,619 | 8/1987 | Langen et al. | 19/159 A |

FOREIGN PATENT DOCUMENTS

| | | | |
|---|---|---|---|
| 0344484 | 12/1989 | European Pat. Off. | 19/159 R |
| 0014869 | of 1881 | Fed. Rep. of Germany . | |
| 0579099 | 6/1933 | Fed. Rep. of Germany . | |
| 0843515 | 7/1952 | Fed. Rep. of Germany . | |
| 1107566 | 5/1961 | Fed. Rep. of Germany . | |
| 3621794 | 1/1988 | Fed. Rep. of Germany . | |
| 1257345 | 2/1961 | France . | |
| 7020134 | 7/1970 | Japan | 19/159 A |
| 0440058 | 12/1967 | Switzerland . | |
| 0494703 | 9/1970 | Switzerland . | |
| 1219514 | 3/1986 | U.S.S.R. | 19/159 R |
| 0333396 | 8/1930 | United Kingdom | 19/159 A |
| 0334413 | 9/1930 | United Kingdom | 19/159 A |
| 0910762 | 11/1962 | United Kingdom | 19/159 R |

*Primary Examiner*—Clifford D. Crowder
*Assistant Examiner*—Ishael Izaguirre
*Attorney, Agent, or Firm*—Sandler Greenblum & Bernstein

[57] ABSTRACT

An apparatus and method for filling textile material into containers having an elongate cross-section, contemplates suspending each container by releasable holder elements secured to displacement devices. Advantageously further provided for each container, during the filling operation, is an external elevation positioning device which can be releasably coupled with the container to be filled with textile material. A displacement device moves the container which is being filled beneath a coiler to deposit loops of the textile material into the container. A device serves to automatically remove the filled containers and a further device delivers empty containers which are to filled.

37 Claims, 5 Drawing Sheets

METHOD AND APPARATUS FOR FILLING TEXTILE MATERIAL INTO CONTAINERS HAVING AN ELONGATE CROSS SECTION

CROSS REFERENCE TO RELATED APPLICATION

This application claims the priority of Swiss application Ser. No. 01 688/90-0, filed May 18, 1990 at the Swiss Patent Office and the Disclosure of which is incorporated herein in its entirety by reference.

BACKGROUND OF THE INVENTION

1. Field of the Invention

The present invention relates to a new and improved method of, and apparatus for, filling textile material into containers having an elongate or extended cross-section.

In its more specific aspects, the apparatus and method for filling textile material into containers or cans or the like having an elongate or extended cross-section, are of the type wherein the textile material is delivered in the form of slivers from a stationary and rotatably driven funnel wheel or coiler and deposited into the associated container or can in the form of loops or convolutions and such container or can carries out a to-and-fro or traversing or reciprocating movement during the filling operation.

DESCRIPTION OF THE RELATED ART

As to practical embodiments for filling textile material into containers or cans having an elongate or extended cross-section, such as known in the art, for example, from German Patent No. 1,107,566, published May 25, 1961, the containers or cans or the like which are to be filled, are deposited upon to-and-fro movable carriages or platforms. Above the container or can there is located a rotatable funnel wheel or coiler which is mounted in a spatially fixed position. This funnel wheel or coiler delivers the textile material to the container or can in the form of slivers. In the therein depicted embodiment there are used containers or cans having an elongate or extended cross-section and which are sub-divided into a number of compartments.

In the additionally known German Patent No. 579,099, granted Jun. 20, 1933, there is disclosed an apparatus for filling containers or cans having an elongate or extended cross-section. The container or can which is located in its filling position, as viewed in the longitudinal direction, has associated therewith in a reserve position an empty container or can. Both of these containers or cans are mounted upon a platform which can be reciprocated or moved to-and-fro by a gearing drive.

With the heretofore considered filling apparatuses relatively large masses must be moved during the to-and-fro movement of the containers or cans, since not only the container or containers must be correspondingly accelerated or decelerated, as the case may be, but also the platforms or carriages carrying such containers or the like.

This requirement imposes exceedingly great demands upon the drive and drive elements and constitutes a limiting factor as concerns possibly increasing the delivery velocity of textile material, such as slivers, which are infed, for example, by a funnel wheel or coiler.

In order to reduce the mass moment of inertia, it is necessary to use smaller and narrower containers or the like upon increasing the delivery velocity of the textile material, and thus, upon increasing the translational velocity.

However, this measure results in an impairment of the standing stability or steadiness of the containers, especially transverse to the longitudinal direction of such containers, and hence, requires the use of additional guide elements when these containers are moved by conventional and known devices.

In German Patent No. 843,515, published Jul. 10, 1952, it has been proposed for the purpose of securing circular containers or cans during the filling operation, to suspend the containers or cans at a holder beneath the rotary filling or coiling head. The holder, which is equipped with receiving brackets for the containers or cans, during a filling operation is placed into a circulatory movement by a crank drive. This apparatus is shown used only with circular containers or cans. The limited horizontal movement which is performed serves to superimpose the rotational movement of the rotary filling head arranged above the container or can for the purpose of depositing cyclical convolutions or coils of the sliver. Additionally, with this prior art apparatus there is not provided any completely automated operation, especially as concerns the infeed and outfeed of the containers or cans, and it is not specifically disclosed in such document that such apparatus be employed for the filling of containers or cans having an elongate or extended cross-section.

SUMMARY OF THE INVENTION

Therefore, with the foregoing in mind, it is a primary object of the present invention to provide an improved method of, and apparatus for, filling sliver-like textile material into containers or cans or the like having an elongate or extended cross-section, which are not afflicted with the aforenoted limitations and drawbacks of the prior art.

Another and more specific object of the present invention aims at the provision of an improved apparatus and method for filling textile material into containers or the like having an elongate cross-section, which, on the one hand, afford an exact positioning of the upper rim or edge of the container, and thus, optimum filling of the container with textile material, and moreover, because of the increased delivery or infeed velocity of the textile material render possible a high translational or to-and-fro movement of the container.

Still a further, noteworthy object of the present invention is the provision fully automated container-filling apparatus and method of the aforementioned type which enables achieving an optimum density of filling of the containers or the like with sliver-like textile material, particularly through the use of a container having an elevationally positional bottom or floor.

Now in order to implement these and still further objects of the present invention, which will become more readily apparent as the description proceeds, the container-filling apparatus of the present development is manifested, among other things, by the features that the container is suspended by releasable holders or holder means constituted by holder elements secured to at least one displacement device or means.

As alluded to above the invention is not only concerned with an improved container-filling apparatus, but also is directed to an improved method of filling containers having an elongate cross-section and a longitudinal direction of extent with a sliver-like textile material, which comprises the steps of suspending the container to be filled with sliver-like textile material in spaced relationship from a floor or supporting surface, depositing loops of sliver-like textile material into the container, and moving the container to-and-fro in the longitudinal direction of extent thereof during the filling operation while in a suspended condition spaced from the floor or supporting surface.

For functional ease in operation, the present invention further proposes constructing the holder elements as grippers which are pivotable about essentially vertical or upright shafts or axles.

In order to facilitate the exchange of filled containers for empty reserve containers held in a reserve or preparatory position, it is further proposed to provide at the region of each longitudinal or lengthwise side of the container a respective displacement device having releasable holder elements.

To achieve an optimum filling density of the containers with textile material and to compensate the momentary filling height, the container is provided with a bottom or floor which is elevationally positionable or shiftable.

It is advantageously contemplated to provide an external elevation positioning or lifting means or device for the elevationally positionable or shiftable container bottom or floor. In this way, there can be beneficially exerted, on the one hand, a predeterminate compression force upon the textile material during the filling operation, and, on the other hand, there is only required a single elevation positioning or lifting means or device .for all of the containers or cans or the like. As a result, there can be desirably dispensed with the use of present day conventional spring elements which are integrated into the containers or the cans.

A control serves to regulate the elevating or lifting velocity and/or to adjust a preselected elevating or lifting force, and thus, enables accommodation to the momentary filling steps or operations and to different textile materials which are to be filled into the containers or the like. In other words, upon infeeding an empty container in place of a previously filled container, the raising or elevation of the container floor can be executed by the elevation positioning or lifting means at a rapid speed until reaching a preselected and defined working position and there can be controllably realized, during the container filling operation, a predetermined force-displacement curve.

If the elevation positioning or lifting means is constructed as a drive equipped with a worm shaft, then there is present a self-locking elevation positioning or lifting means, and there can be realized relatively large elevation or lifting strokes or movements with short drive paths and with a compact drive unit.

It is additionally contemplated that the elevation positioning or lifting means be mounted at an entrainment element or means which can be operatively coupled with the container. Consequently, following decoupling of the entrainment element or means from the container, it is possible to easily transfer the elevation position or lifting means to a reserve container or can which is to be subsequently placed into a textile material filling position.

This operation is particularly readily realized if the entrainment element or means is constructed as a carriage or trolley or the like which is guided beneath the container and which is provided with coupling elements for entrainment by the container.

For the automatic transfer of the carriage or trolley to a container held in a reserve position, it is contemplated to operatively associate with the carriage or trolley a displacement device which can be operatively coupled with the carriage or trolley.

In order to attain an optimum infeed and outfeed of the containers, it is proposed to provide at both sides of the container, as viewed in the longitudinal direction of the container located in its filling position, on the one hand, at least one deposit position or location for the filled containers, and, on the other hand, at least one deposit position or location for an empty container. What is significant in this regard is that the displacement device also extends into the relevant deposit position or location for the respective filled and empty container.

Additionally, it is contemplated to provide a sliver severing or separating device at the region of the deposit position or location for the filled container. This sliver severing or separating device, which defines a stationary or spatially fixed clamping device, can comprise a pivotable clamping or pinching ledge member which coacts with the gripper or gripper element still located in its container-clamping position, of the ejected filled container and which is situated closest to the funnel wheel or coiler. As a result, it is possible upon clamping the sliver which interconnects both of the containers, to then achieve severing of the sliver when the empty container now located in the filling position is distanced, during the container filling operation, from the prior filled and ejected container. Consequently, the sliver is drawn apart and severed at a defined clamping location. Upon releasing the grippers from their engagement with the filled container and subsequently setting down the previously suspended filled container, for instance, upon an infed deposit or receiver device, the end of the sliver comes to lie in a defined region beneath the rim or edge of the container and at the region of a narrow or small side of the container. What is a prerequisite for this operation is that, the exchange of the containers occurs at that point in time during which the region of the narrow side of the container is located below the funnel wheel or coiler which is situated closest to the empty container which is to be infed.

Regarding the proposed container filling method, it is suggested to control the velocity of the to-and-fro or traversing movement of the containers in accordance with the position of the funnel wheel or coiler with respect to the relevant narrow side of the container located in the filling position. In this respect the velocity of the translatory or to-and-fro movement of the container should be briefly increased shortly prior to reaching the movement reversal point or location of the container, and after moving past the same this velocity should be reset to a predetermined translatory or to-and-fro velocity. By virtue of these measures, there is achieved a uniform distribution of the textile material with respect to the container filling height, in other words, by virtue of the reversal of the container movement direction there are not formed any accumulations of textile material at the region of both narrow or small sides of the container.

Due to the premature decoupling of the elevation positioning or lifting means or device from the container located in the filling position, prior to deposition of the last filling layer of the sliver-like textile material, it is ensured that the elevation positioning or lifting means or device can be transferred at the proper point in time to the empty container held in readiness or reserve. Consequently, there do not arise any idle times and the container exchange operation can be accomplished without interruption or, so-to-speak, in a seamless fashion.

The clamping or restraining of the sliver by means of the stationary clamping device between the outfed filled container and the infed container located in the textile material filling position, renders possible a positioned or spatially defined tearing or severing of the sliver at that moment in time when the filled container and the container disposed in the filling position move apart.

To achieve an optimum degree of filling of the container, it is proposed to have the container perform a lateral transverse movement, after moving beyond the momentary reversal point, which amounts to about the thickness of the sliver. This produces a lateral shift of the deposited loops or convolutions of the textile material and a increase in the degree of filling of the containers. This can be, for instance, accomplished by appropriately tilting the container.

In order to accommodate the overlapping of the deposited textile material loops or convolutions at the region of a reversal point, it is suggested to adjust or set the magnitude of the to-and-fro or traversing movement of the containers as a function of the degree of filling or the filling height of the container with textile material. For instance, such adjustment or setting of the to-and-fro movement of the container can be accomplished in that with each second lengthwise movement of the to-and-fro moving container there is reduced the displacement path of the container from a narrow side of the container by an amount corresponding to at least the thickness of the sliver-like textile material.

For qualitative reasons, it is further contemplated that upon interruption of the delivery of the sliver during the filling operation, to exchange the container located in the filling position for an empty reserve container located in a preparatory or reserve position. As a result, there is prevented that an impairment of the sliver quality, for instance, at the region of a piecing, will be delivered to subsequent textile material processing machines. The thus ejected container is then delivered to a reclaiming or recovery operation at preceding process stages, for example, in the cleaning room.

To achieve an accurate and non-problematic filling operation, it is proposed to group together in a central control unit the control for the machine supplying the textile material, the funnel wheel or coiler drive, the displacement device for the containers as well as for the infeed and outfeed devices for empty containers which are to be infed and for filled containers which are to be outfed and for the elevation positioning or lifting means for the container floors.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the container filling station including the apparatus for filling textile material into containers having an elongate or extended cross-section has been depicted therein, in order to simplify the illustration, as needed for those skilled in the art to readily understand the underlying principles an concepts of the present invention.

Figure 1:
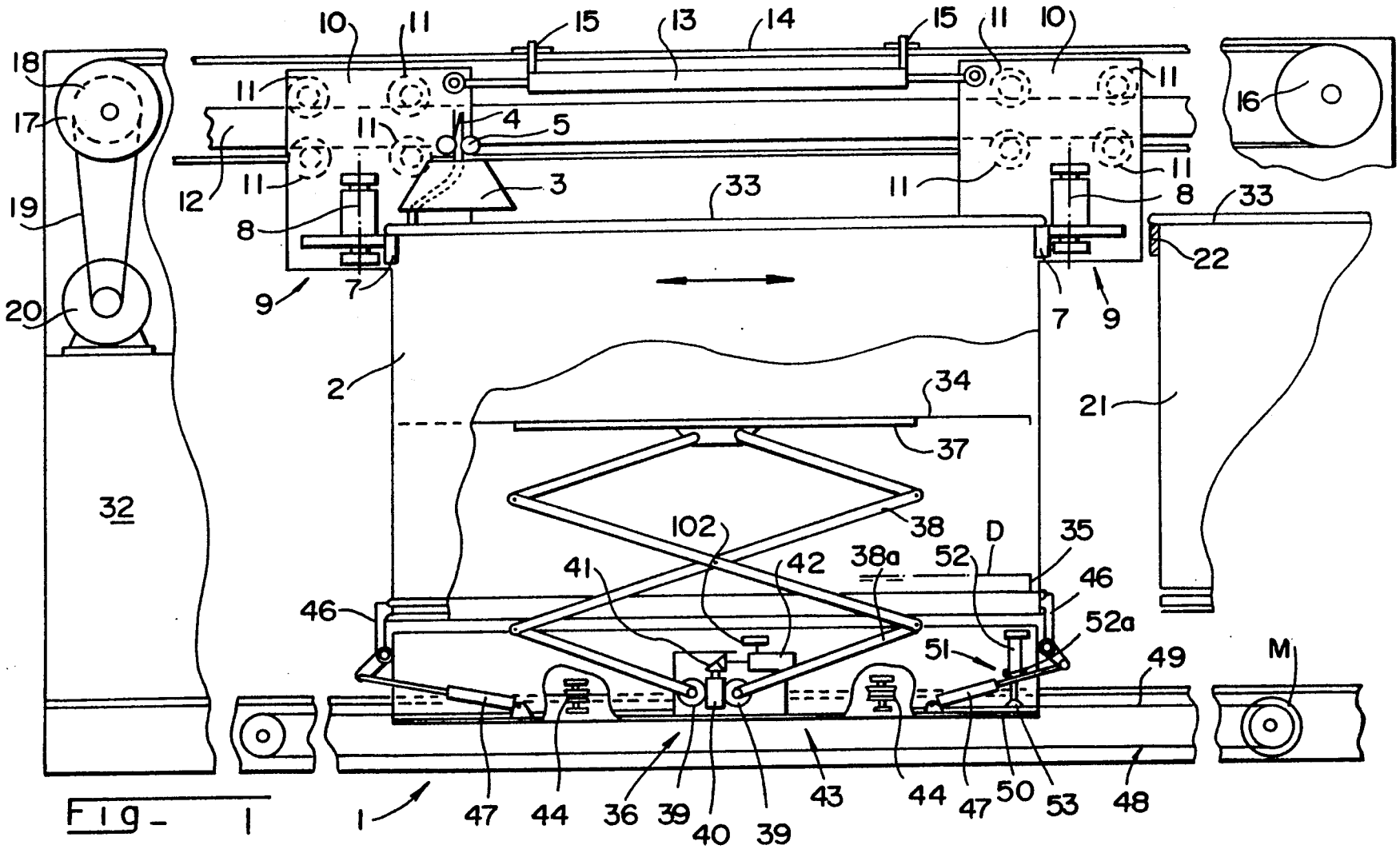
FIG. 1 is a schematic side view of an exemplary embodiment of a filling station including an apparatus for filling sliver-like textile material into receptacles, such as containers or cans having an elongate cross-section.

Turning attention now to FIG. 1, there is depicted therein an exemplary embodiment o f filling station 1 where a container or can 2 or like receptacle having an elongate or extended cross-section and a longitudinal direction of extent, is located in a filling position for filling, for instance, with sliver-like textile material. In the disclosure to follow the elongate containers or cans will be usually simply referred to as containers. A suitable funnel wheel or coiler 3 or equivalent structure having a suitable funnel wheel or coiler drive 108 (FIG. 2) delivers a fiber sliver 4 to the container 2. To enhance the illustration only a short segment or section of the sliver 4 has been depicted. The funnel wheel or coiler 3 is rotatably but stationarily or spatially fixedly arranged in a suitable and therefore here not further shown frame or the like. The sliver 4 is delivered in known manner by means of calender rolls 5 to the funnel wheel or coiler 3 after such sliver 4 has been delivered from a suitable textile material-delivery machine or unit, for instance, from a draw frame 6 to the calender rolls 5. The draw frame 6 has been schematically depicted in FIG. 2. It is here remarked that the diameter of the funnel wheel or coiler 3 approximately corresponds to the width of the narrow or small side of the container 2.

In the container filling position within the filling station 1, the container 2 is retained in a suspended position by releasable holder means in the form of holder or holding elements comprising pivotable grippers or gripper elements 7, that is to say, the suspended container 2 is not in contact with the mill floor or supporting surface. Furthermore, as best seen by referring to FIG. 2, the grippers 7 engage the container 2 in pairs at the region of the upper container rim or edge 33 (FIG. 1) and at the oppositely situated narrow or small sides of the container 2.

Although not particularly shown, it is possible to provide reinforcements at the upper region of the containers 2 which, on the one hand, serve to dimensionally stabilize each such container 2 and, on the other hand, when appropriately shaped facilitate the reception of the engaging grippers 7.

Each of the grippers 7 is pivotably mounted by means of a pivot shaft or axle 8 at an associated displacement device or means 9. Each displacement device 9 comprises a substantially vertically mounted or upright plate or plate member 10 which, with respect to the containers 2, is provided with pairs of outwardly directed guide rolls or rollers 11. These guide rolls 11, wherein each pair comprises two guide rolls 11 arranged in vertically superimposed relationship as shown in FIG. 4, are vertically aligned and each bear against a guide rail 12.

Figure 4:
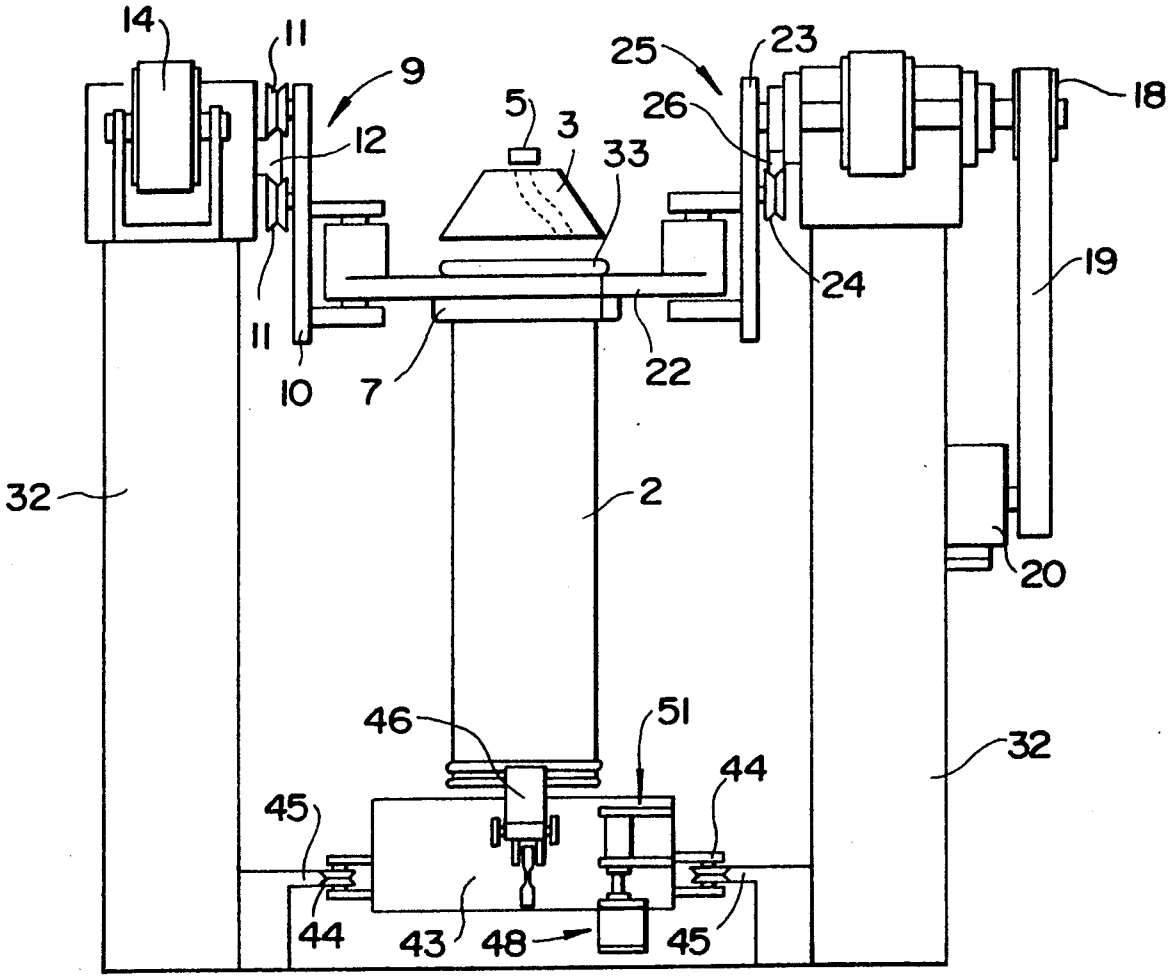
FIG. 4 is a schematic end view of the arrangement depicted in FIG. 1.

This coaction of the guide rolls 11 and the guide rails 12 is particularly well portrayed in such FIG. 4. By virtue of this guide structure composed of the guide rolls 11 and the guide rails 12 there is advantageously ensured that the plates 10 together with the grippers 7 are exactly guided in horizontal and vertical position during the displacement thereof. The displacement devices 9, each of which are arranged at the region of an associated narrow or small side of the related container 2, are operatively connected with one another by a suitable drive, here shown as a piston-and-cylinder unit 13, for instance, a fluid-operated, such as a pneumatic piston-and-cylinder unit, which during the time that there is fixedly retained a container 2 biases or urges both of the displacement devices 9 towards one another, and thus, retains the grippers 7 in contact with the associated container 2.

During the container filling operation there is applied to the container 2 a traversing or to-and-fro or reciprocatory movement in the longitudinal or lengthwise direction of extent of the container 2, so that this container 2 moves throughout its entire length beneath the funnel wheel or coiler 3. In order to transmit this traversing or to-and-fro movement, that is, the container reciprocating or translatory movement, the piston-and-cylinder unit 13 which biases or urges both of the displacement devices 9 towards one another, is attached by means of brackets or connectors 15 or the like to a movable belt or band member 14 or equivalent structure. This belt or band member 14 is advantageously constructed as a toothed belt so as to be able to transmit an accurate traversing movement to the containers 2. This belt or belt member 14 is trained about the pulleys or disks 16 and 17, and the one pulley or disk 17 is appropriately constructed as a drive pulley or disk. A belt pulley 18 is arranged coaxially with respect to the pulley or disk 17. A belt or belt member 19, driven by a suitable reversible drive motor 20, is trained about the belt pulley 18. During a container filling operation, the drive motor 20 periodically reverses its driving direction whenever a narrow or small side of the container 2 is approximately coincident or aligned with the periphery of the rotatable funnel wheel or coiler 3. Such a position has been depicted in FIG. 1.

Figure 2:
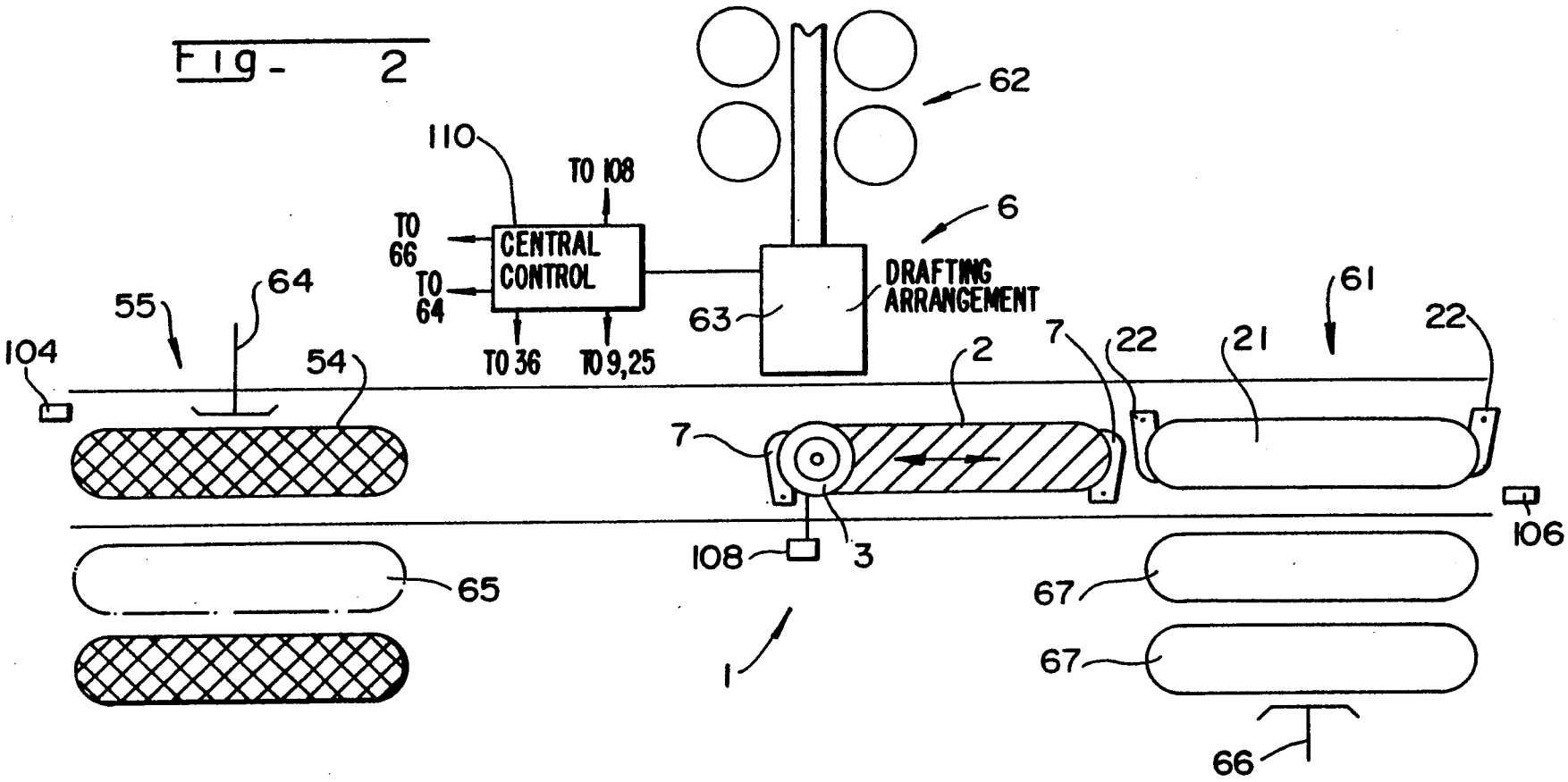
FIG. 2 is a schematic top plan view of the filling station and serving to explain the inventive method of filling the sliver-like textile material into the containers or cans having an elongate cross-section.
Figure 3:
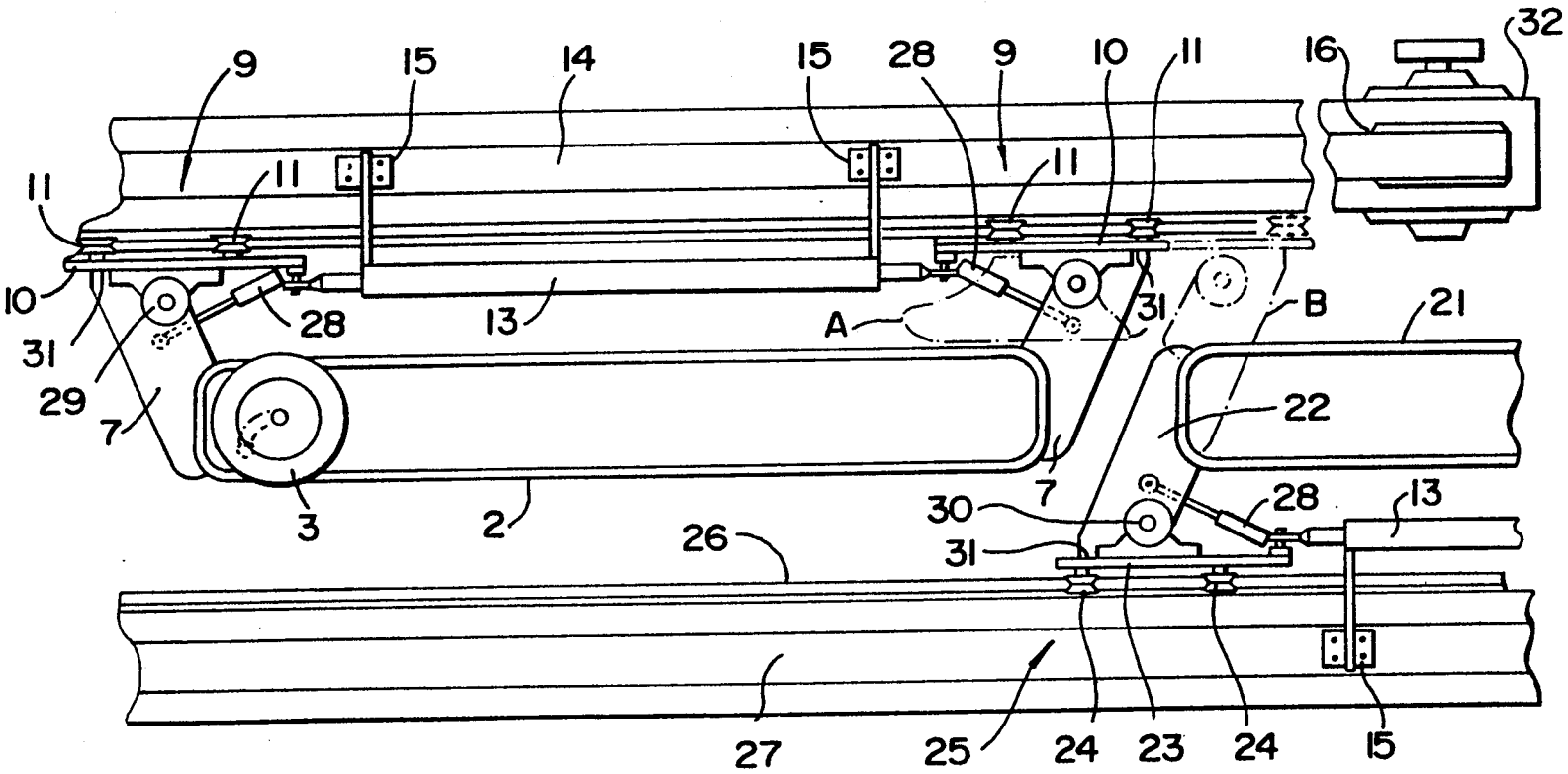
FIG. 3 is a schematic top plan view of the arrangement depicted in FIG. 1.

As will also be seen in FIGS. 1 and 2, a further container 21, a so-called reserve container, is arranged in a suspended position or state in a preparatory or reserve position, by releasable holder means comprising holder elements constituted by grippers or gripper elements 22, adjacent the container 2 located in its filling position. As particularly will be also recognized from FIG. 3, the depicted gripper or gripper element 22 is pivotally arranged, as is also the non-visible gripper 22 at the opposite end of the reserve container 21, at an associated displacement device or means 25 which is arranged opposite to the displacement devices 9 in relation to the container 2, that is, at the opposite side of the longitudinal or lengthwise axis of such container 2. The grippers 22, only one of which is shown in FIG. 3, are each pivotally or hingedly mounted at an associated plate or plate member 23 which, like the plate members 10, is provided with guide rolls or rollers 24. Just as was the case for the guide rolls 11, these guide rolls 24 are guided upon a guide rail 26. Comparable to what was previously described in connection with the displacement devices 9, here also the displacement devices 25 are also biased or urged towards one another by means of a suitable drive unit, like, for instance, a further fluid-operated, such as a pneumatic piston-and-cylinder unit 13. Equally, this further pneumatic piston-and-cylinder unit 13 is operatively connected by brackets or connectors 15 or equivalent structure with a further belt or band member 27. The drive and the mounting and construction of the belt or band member 27 advantageously can correspond to the corresponding structure associated with the belt or band member 14, so that further details need not be here given.

By way of completeness it is remarked that the connection of the brackets or connectors 15 with the belt 14 and the belt 27, as the case may be, can be accomplished by clamping elements, threaded screws or bolts, rivets or other suitable attachment elements.

Continuing, and as will be understood from FIG. 3, a respective piston-and-cylinder unit 28 hingedly connected with the related plate 10 and 23, is provided for each of the grippers 7 and 22 in order to undertake the pivotable or rocking movement of these grippers 7 and 22 about their related shaft or axle 29 and 30, respectively. A pivoted-in or turned-in gripper position, wherein the grippers 7 and 22, as the case may be, have been pivoted-in past the neighboring longitudinal or lengthwise side of the associated container 2 or 21, has been shown in chain-dot lines and designated by reference character A in FIG. 3. Such pivoted-in gripper position A is required whenever there is to be undertaken an exchange of a filled container 2 for an empty or reserve container 21. This operation will be discussed in greater detail hereinafter.

In the container-retention position of the grippers 7 and 22, each of these grippers 7 and 22 are braced by an associated support or impact surface 31 against the related plate or plate member 10 and 23, respectively. Moreover, it is here observed that there can be also used, instead of the piston-and-cylinder units 28, other elements for the purpose of pivoting and retaining in a desired position the grippers 7 and 22, such as, for example, springs. FIG. 3 additionally indicates the mounting of the pulley 16 at the frame 32.

FIG. 3 further depicts in chain-dot lines, indicated by reference character B, a further position of one of the grippers 7 which is assumed by each of the grippers 7 and 21 when the associated piston-and-cylinder unit 13 has been thrusted into an extended position. This position is reached upon displacing the corresponding displacement devices, such as the displacement devices 9, and thus the associated grippers 7 and constitutes a container release or receiving position for the container 2. Here too, this operation will be considered in greater detail hereinafter.

In the exemplary embodiment under discussion, the containers 2 and 21 are each equipped with upper container rims or edges 33 which protrude beyond the outer surface or jacket of the corresponding container. Each such container rim or edge 33 serves, on the one hand, to reinforce the related container and, on the other hand, to enable container-engagement by the grippers 7 and 22 due to one or the other of the pairs of grippers 7 or 22, as the case may be, engaging beneath the related container rim or edge 33.

According to the invention, each of the containers 2 and 21 are provided with a movable container floor or bottom 34. In the lowermost position D of each such container floor or bottom 34 the latter rests upon an internal container edge or shoulder 35 located at the lower region of the corresponding container 2 or 21. This lowermost or lower position D of the container floor or bottom 35 of the container 2 has been shown in chain-dot lines in FIG. 1. During a container filling operation, the container floor or bottom 34 is controllably moved or positioned by an elevation positioning or lifting means or device 36 as a function of the filled quantity of textile material. It is important to perform this operation in order to achieve an orderly and optimum filling of textile material, here the sliver 4, into the associated container 2 or 21, as the case may be.

Prior to the start of filling a container with the sliver-like textile material, such as the container 2 depicted in FIG. 1, the container floor or bottom 34 is displaced at a relatively high speed or in a rapid movement mode by means of the elevation positioning or lifting device 36 into an upper position adjacent to the lower edge of the funnel wheel or coiler 3. After starting the textile material filling operation the container floor or bottom 34 is incrementally lowered by the elevation positioning or lifting device 36 as a function of the quantity of textile material filled into the container 2. During this displacement or positional shifting of the container floor or bottom 34 care should be taken to ensure that, as a function of the amount of textile material which has been filled into the container 2, there is always exerted an optimum counter pressure or force against the lower edge of the funnel wheel or coiler 3.

In the full-line position of the container floor 34 depicted in FIG. 1, this container floor 34 is located approximately at the middle of the container 2, that is, this container 2 is approximately half-filled with the sliver-like textile material or coiled sliver 4. However, to facilitate the illustration there has not been specifically shown the coiled sliver 4 which has been deposited into the container 2. It will be observed that the container floor 34 rests upon a plate or plate member 37 which, in turn, is carried by a scissor or scissor-like mechanism or pantograph 38 or equivalent structure. The lower arms or links 38*a* of the scissor mechanism 38 are rigidly connected for rotation with gears 39 which mesh with a worm shaft 40 or equivalent structure. It is possible to rotate the worm shaft 40 and the gears 39 by means of a bevel gear drive 41 driven by a drive motor 42. The control of the displacement path of the scissor mechanism 38 is accomplished as a function of the delivered quantity of textile material which can be detected, for instance, at the calender rolls 5 by any suitable sensor. For this purpose, a suitable control 102 can cooperate with the drive motor 42 for controlling the displacement path of the scissor mechanism 38 and for controlling the velocity of the elevational movement and/or for setting a predetermined lifting force of the displaceable container floor or bottom 34.

The elevation positioning or lifting device 36 is supported at a displaceably mounted carriage or trolley 43 or the like which is arranged beneath the container 2 shown in FIG. 1. As will be apparent from FIG. 4, this carriage 43 is provided at both of its longitudinal or lengthwise sides with substantially horizontally oriented guide rolls or rollers 44 which are guided at associated guide rails or rail members 45. As depicted in FIG. 1, the length of the carriage or trolley 43 corresponds approximately to the length of each of the containers 2 and 21.

The elevation positioning or lifting device or means could be differently constructed from what has been previously discussed. As a modified arrangement, there could be used as the elevation positioning or lifting device or means magnets, such as electromagnets, which are vertically guided along the outer surface or jacket of the associated container 2 or 21, as the case may be, and which positionally shift and retain in the desired shifted and elevated position an associated metallic plate-like container floor or bottom. In order to horizontally stabilize such metallic plate-like container floor the latter may be provided with additional guides. The magnets, as stated, for example, electromagnets, are then coupled with the containers and arranged to be horizontally and vertically displaceable.

In the exemplary embodiment under consideration, at the region of the narrow or small sides of the carriage 43 there are provided pivotally mounted coupling devices or elements 46 defining pivotable gripper arms, which can be inwardly pivoted at the lower region of the associated container 2 or 21 into the predetermined path of container displacement, as the case may be, for coupling engagement with such container 2 or 21. In FIG. 1 the coupling devices or elements 46 have been depicted operatively coupled with the shown container 2, so that by means of these coupling devices or elements 46, during the traversing or to-and-fro movement of the container 2, the carriage 43 is correspondingly entrainably moved. The coupling devices 46 are pivoted by means of the associated drive units, here shown as fluid-operated piston-and-cylinder units 47.

At the lower region of the carriage 43 there is arranged a displacement device comprising a belt drive 48, the upper run 49 of which is located within the carriage 43 above the lower surface 50 of such carriage 43. Within the carriage 43 there is located a clamping device 51 which is equipped with a suitable drive device, here shown as a fluid-operated piston-and-cylinder unit 52. The free end of the cylinder 52*a* of the piston-and-cylinder unit 52, which is provided with a pressure or pressing disk 53, is located above the upper run 49 of the belt drive 48 and the lower surface 50 of the carriage or trolley 43. Upon impingement of the piston-and-cylinder unit 52 with pressurized fluid medium, the upper run 49 of the belt drive 48 is clamped by the pressure or pressing disk 53 against the lower surface 50 of the carriage 43. Thus, when the belt drive 48 is moved by the drive motor M, following release of the coupling devices 46, the carriage or trolley 43 can be shifted by means of the belt drive 48.

Figure 5:
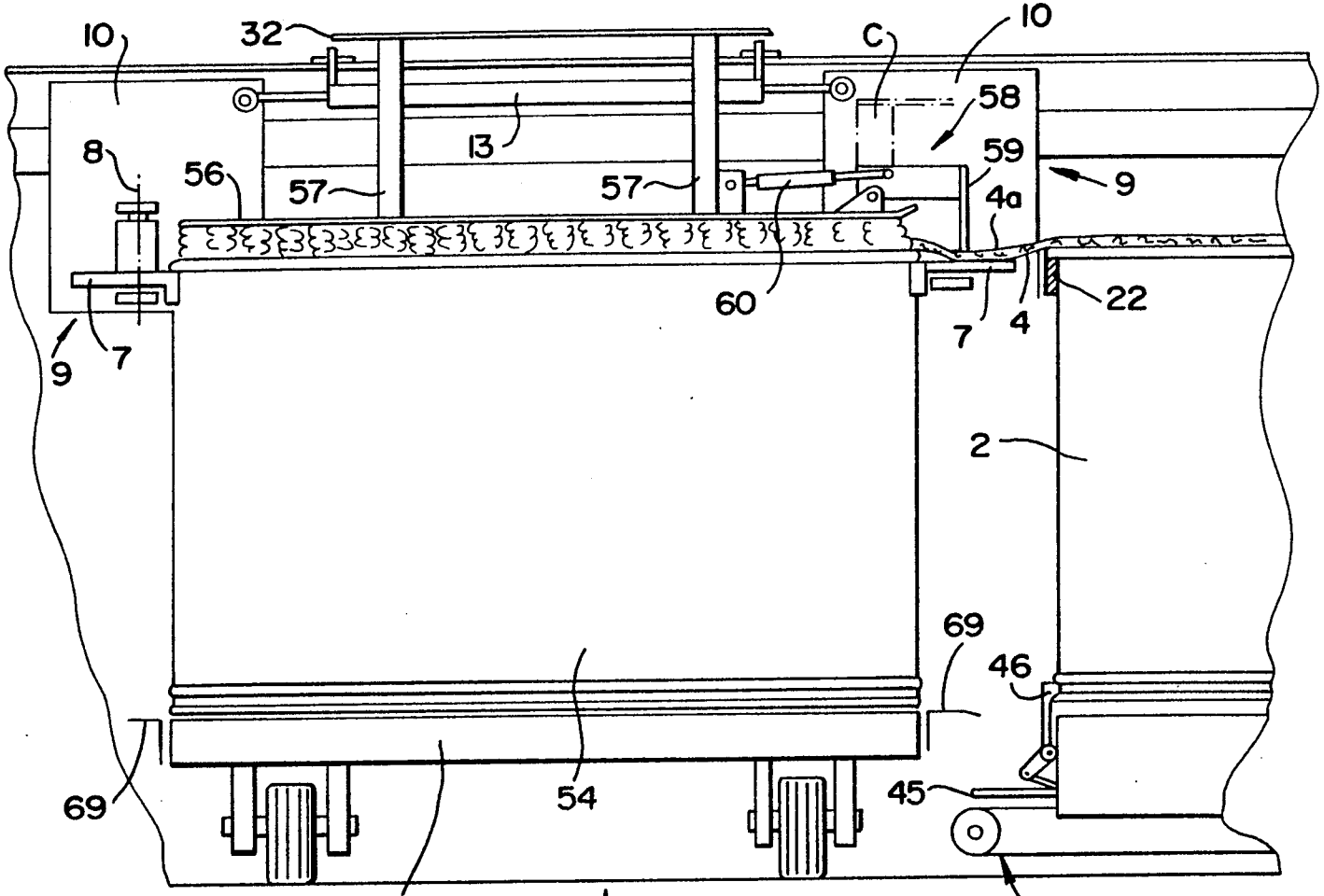
FIG. 5 is a schematic side view of the filling station depicted in FIG. 1 including a sliver severing or separating device.

FIG. 5 depicts a container 54 which has been filled with sliver-like textile material and is now located externally of the container filling position, that is to say, outside of the filling station 1. In other words, this filled container 54 has been displaced by means of the displacement devices 9 or 25, as the case may be, into a position which, in the exemplary embodiment under discussion, is conveniently designated as a full container storage or deposit means or position 55 (see FIGS. 2 and 5). This full container storage or deposit means or position 55 can be provided with a suitable monitoring sensor 104 for detecting the existence of full containers thereat. Between the container 2 which has been infed to the filling station 1 and which is now located in the filling position at such filling station 1 there exists a physical connection with the sliver 4 which has not yet been severed and which has been continuously further infed during the container exchange operation. A guide or guide plate 56, formed from, for instance, sheet metal, is arranged above the container 54 and is secured by supports or connectors 57 at the frame 32.

This guide plate 56 serves to downwardly press or urge the contents of the filled container 54, here the coiled loops or convolutions of the sliver 4.

At the region of the one support 57 there is arranged a pivotal textile material severing or separating device 58 containing a severing knife or cutter 59. In the embodiment under consideration and as shown in FIG. 5, the severing knife or cutter 59 is seated upon a surface of the neighboring gripper 7 and clamps the sliver 4 which interconnects the containers 2 and 54. As soon as during the container traversing or to-and-fro movement the container 2 which is be filled with sliver 4 moves away from the neighboring container 54 which has previously been filled with sliver 4 then the portion or segment 4a of the sliver 4 interconnecting these containers 2 and 54 is pulled apart and thus severed. After this sliver severing or separating operation, then the severing knife or cutter 59 is upwardly pivoted into the chain-dot position C by means of the piston-and-cylinder unit 60 and is held in a preparatory position to be able to accomplish the next sliver severing operation.

Now based upon the illustration of FIG. 2 there will be considered hereinafter further details of the inventive method of filling textile material into containers having an elongate cross-section.

The conventional draw frame 6 shown in FIG. 2 has only been schematically illustrated and is provided with the generally indicated infeed or delivery table 62 and the actual drafting arrangement 63. To preserve clarity in the illustration there has been conveniently omitted the connection of the drafting arrangement 63 with the subsequently arranged funnel wheel or coiler 3. This connection can be arranged directly following the outlet or delivery side of the drafting arrangement 63, that is to say, the drafting arrangement 63 partially protrudes over the filling station 1. However, it is also possible that the sliver 4 which is delivered by the drafting arrangement 63 is delivered to the funnel wheel or coiler 3 by means of a special infeed or delivery device.

The slivers which are withdrawn from a plurality of circular cans or containers 100 located at the infeed or delivery table 62, for instance, six such cans 100 although only four cans 100 have been depicted in FIG. 2, are delivered to the drafting arrangement 63, gathered together or doubled and drafted. The thus formed sliver 4 is delivered to the funnel wheel or coiler 3 which deposits the sliver 4 in the form of loops or convolutions into the container 2 located beneath such funnel wheel or coiler 3. During this sliver deposition operation the elongate container 2 performs a traversing or to-and-fro or reciprocatory movement beneath the funnel wheel or coiler 3, that is to say, this container 2 moves to-and-fro between the empty or reserve container 21 and the previously ejected full container 54. During this container traversing motion, the container 2 which is to be filled with the textile material is retained in a suspended state by means of the engaged grippers or gripper elements 7.

The container traversing or to-and-fro movement is accomplished by means of the previously discussed displacement devices 9 in conjunction with the belt drive 14. Further details concerning the operation of the displacement devices 9 need not be here given since such have been previously considered with particularity. During the filling of the container 2 the carriage or trolley 43 equipped with the elevation positioning or lifting device 36 is operatively coupled with the lower portion of this container 2 in the manner previously discussed. This elevation positioning device 36 ensures for the proper elevational position of the displaceable container floor or bottom 34 as function of the degree of filling of the container 2 with the loops of sliver 4. During the traversing or to-and-fro movement of the container 2, it is possible to have different lengths of the traversing strokes in order to avoid the accumulation of textile material at the region of the narrow or small sides of the container 2. This stroke length change can be accomplished by appropriately controlling the speed of the drive motor 20.

The degree of filling of the container 2 with sliver 4 can be determined either by suitable feeler or sensor elements directly associated with the container 2 or else by measuring the length of the sliver 4 which has been delivered to the container 2. Shortly prior to terminating the container filling operation, that is to say, when there are still to be deposited only two or three sliver layers, the container floor 34 is located approximately at the position D which has been, depicted in FIG. 1 in chain-dot lines. The scissor or scissor-like mechanism 38 is now displaced by means of the elevation positioning device 36 completely downward out of the displacement or movement path of the container 2 and at the same time there are released the coupling devices or coupling means 46. This operation is triggered when, for instance, the container 2 has assumed the position depicted in FIG. 2. In a timed sequence after releasing the coupling devices 46 there is impinged with pressurized fluid medium the clamping device 51 which operatively interconnects the carriage 43 with the belt drive 48. At the same time, or else shortly thereafter, the belt drive 48 is placed into movement by the drive motor M, that is, the upper belt run 49 moves in the direction of the empty container 21, and thus, displaces the carriage 43 beneath this empty container 21. In this connection, measures may be undertaken to control the displacement path of the carriage 43 by a terminal stop or by a suitable path-dependent control.

After the carriage 43 has been properly positioned beneath the empty container 21, then the clamping device 51 is released and the belt drive 48 brought to standstill. Upon actuating the coupling devices or means 46 there is established an entrainment connection between the carriage 43 and the empty container 21. As soon as the coupling devices 46 have engaged the empty container 21, then the elevation positioning device 36 rapidly upwardly shifts the container floor 34 by means of the scissor mechanism 38 into its uppermost container filling position. Prior to displacement of the carriage 43 the empty container 21 is located in its suspended state by virtue of the engagement of the grippers or gripper elements 22. This empty container 21 is now prepared to be next filled with textile material. During the preparation time for the empty container 21 there is completed the filling of the container 2 with textile material.

During the filling of the empty container 2 an ejector or removal device 64 has displaced the container 54, which previously was shifted into the full container storage or deposit means or position 55, into the deposit position or location 65 shown in chain-dot lines in FIG. 2. Different constructions of the ejector device 64 are possible. For example, and as shown in FIG. 5, a carriage or trolley 68 or the like can be displaced beneath the container 54 prior to release of the grippers 7 or 22, as the case may be, which maintain the container 54 in a raised or suspended state. This carriage or trolley 68, after release of the grippers 7 or 22, then transfers the container 54 deposited thereupon to the deposit position or location 65 shown in chain-dot lines in FIG. 2. The displacement of the container 54 by means of the carriage or trolley 68 is accomplished either manually or else preferably by means of a not particularly shown but suitable automatic displacement device. As will be further seen by inspecting FIG. 5, the carriage or trolley 68 is guided by lateral guides or guide means 69. It is also possible to use, instead of the carriage or trolley 68, a suitable roll track or conveyor track which allows removal of the filled containers 54 out of the filled container storage or deposit means or position 55. Such type equipment is known in this technology in different constructions, and thus, need not be here further considered.

Prior to deposition of the last layer of the loops of sliver 4, when the container 2 is located in the position depicted in FIG. 2, there are activated the displacement devices 25 for the empty container 21 which has already been coupled with the carriage 43. In other words, both of the containers 2 and 21 are now displaced by means of their related displacement devices 9 and 25, respectively, in the direction of the full container storage or deposit means 55. The guides or guide rails 12 and 26 for the displacement devices 9 and 25 extend throughout the entire length of the displacement or shift path of the containers 2 and 21. The filled container 2 is displaced into the full container storage or deposit means 55 which has been emptied in the meantime, while the subsequently infed container 21 is transferred into the container filling station 1. The further infed sliver 4 is now deposited upon the container floor or bottom 34 of the container 21 which now is to be filled with the loops or convolutions of the sliver 4. When the filled container 2 of FIG. 2 has reached the position of the container 54 at the full container storage or deposit means 55, then there has already been deposited by means of the funnel wheel or coiler 3 a first layer of sliver 4 upon the container floor 34 of the newly delivered container 21, but which in FIG. 5 is represented by the container 2. Prior to movement reversal of the container located in its container filling position in the filling station 1, the sliver connecting portion or segment 4*a* (FIG. 5), which is located between the filled container 54 and the container 2 located in its sliver filling position, is clamped by the severing or separating device 58. Then, as previously explained, during the time that the two containers 2 and 54 subsequently move apart this sliver connecting portion or segment 4*a* is drawn apart and thus the sliver 4 is severed. Following this operation, the sliver severing device 58 is pivoted into its upper position C shown in FIG. 5.

After positioning of the carriage 68, which has been previously emptied of the prior outfed full container, beneath the full container 54 shown in FIG. 5, this full container 54 is released by opening the grippers 7 by means of the piston-and-cylinder unit 13 and such full container 54 is placed upon the carriage 68. FIG. 3 likewise shows in chain-dot lines one of the grippers 7 in its container release position B. These grippers or gripper elements 7, after disengagement from the narrow or small sides of the container rim 33 of the associated container, like the container 2 shown in FIG. 3, can be pivoted into a folded-in or pivoted-in position by means of the associated piston-and-cylinder unit 28, as shown by the chain-dot position A in FIG. 3. After the grippers 7 have been folded-in or pivoted-in, such grippers 7 are displaced by the displacement devices 9 and the belt 14 to the region of the empty container storage or deposit means or position 61 shown in FIG. 2. This empty container storage or deposit means 61 likewise can be provided with a suitable monitoring sensor 106 for detecting the presence of empty containers thereat.

By means of a suitable displacement or infeed device 66 a new empty container 21 has been delivered in the meantime to the empty container storage or deposit means or position 61. The grippers 7 are now pivoted by means of the piston-and-cylinder units 28 into their ready position for engagement of a container, as shown, for instance, by the chain-dot position B of FIG. 3, where such outwardly extended or pivoted grippers 7 contact the related plate 10 by means of their associated support or impact surface 31. After actuation of the associated piston-and-cylinder unit 13 there is reduced the spacing or distance between the pairwise coacting grippers 7, so that the container is engaged and clamped by these grippers 7 beneath the container rim 33. In FIG. 2 it is the grippers 22 which have been shown to be in engagement with the new empty container 21, although it will be understood and believed evident that depending upon the point in time of operation of the equipment either the pair of grippers 7 or the other pair of grippers 22 alternately engage successively infed new empty containers 21.

The displacement device 66, which may be constituted by a carriage or trolley which receives the container 21 shown in FIG. 2, after having infed this empty container 21, is shifted away from the region of such container 21 and returns to the region where it is able to infeed further empty containers 67 which have been placed in readiness or reserve. In this way, there is accomplished the release of the container 21 which is now located in a freely suspended state between the container engaging grippers or gripper elements, such as the grippers 22 of FIG. 2.

As already previously described, the next container exchange operation then can be carried out. The displacement devices 9 and 25 are thus alternately in action, once for the infeed of an empty container and for the displacement of a container which is located in its container filling position, respectively.

It is also conceivable to operatively correlate with the described installation or system an additional storage or receiving station for the ejected containers which are then delivered to this additional storage or receiving station when there occurs, for instance, sliver rupture or breakage during a container filling operation. The arrangement of the full container storage and the empty container storage can be accomplished in a manner different from that shown and described by way of example. It is also possible to provide the described installation or system with a suitable container by-pass in order to remove the pieced portion which has been formed when piecing a newly infed or ruptured sliver. In this way, there should be particularly taken into account the required quality of the deposited sliver.

An additional lateral shifting of the displacement devices 9 and 25, as the case may be, during the container filling operation can result in an increase in the degree of filling of the containers due to shifting or displacement of the deposited sliver loops or convolutions. To this end, different constructions are possible for realizing a practical embodiment, but are not here further shown. It is, however, worthy of mention that for this purpose it would be possible to laterally tilt the containers during such time as they are being filled with the sliver 4 as generally indicated in FIG. 2 by the schematically depicted container tilt mechanism 150 constituting means for displacement of the container transverse to its to-and-fro direction of movement.

By virtue of the described arrangement it is possible to reliably continuously fill slivers 4 into elongate containers or the like, and, on the one hand, there is afforded optimum filling of the containers and, on the other hand, only a single elevation positioning or lifting device is required for all of the elevationally positional container floors or bottoms.

Finally, as previously explained, and as schematically shown in FIG. 2, to achieve an accurate and non-problematic filling operation, it is proposed to group together in a central control unit 110 the control of the machine supplying the textile material, such as the draw frame 6, the funnel wheel or coiler drive 108, the displacement devices 9 and 25 for the containers as well as for the infeed and outfeed devices or displacement devices 66 and 64 for empty containers which are to be infed and for filled containers which are to be outfed, respectively, and the elevation positioning or lifting means 36 for the container floors.

The heretofore proposed container infeed or delivery and the outfeed of the containers renders possible a fully automated operation and good accessibility to the filling station.

While there are shown and described present preferred embodiments of the invention, it is distinctly to be understood the invention is not limited thereto, but may be otherwise variously embodied and practiced within the scope of the following claims.

What is claimed is:

1. An apparatus for filling textile material into a container having an elongate cross-section and a longitudinal direction of extent, comprising:

a stationary and rotatably driven funnel wheel for delivering said textile material in the form of a sliver deposition of said sliver in the form of sliver loops into said container having an elongate cross-section and a longitudinal direction of extent;

means for imparting to the container a to-and-fro movement in the longitudinal direction of extent of the container;

said movement imparting means comprising displacement means and releasable holder means secured to said displacement means;

said releasable holder means being releasably engageable with the container for maintaining the container in a suspended position during said filling of the contained with the textile material in the form of said sliver loops, said releasable holder means comprising holder elements comprising grippers;

means for mounting said grippers for pivotal movement about substantially vertically oriented axes;

the container having an elevationally displaceable container floor.

2. The apparatus as defined in claim 1, wherein:

said grippers are located at said displacement means to operate in coacting gripper pairs.

3. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section, a longitudinal direction of extent and a pair of narrow sides;

means for imparting to the container a to-and-fro movement in the longitudinal direction of extent of the container;

said movement imparting means comprising displacement means and releasable holder means secured to said displacement means, said displacement means comprising a respective displacement device located adjacent each narrow side of the container;

each said displacement device being provided with said releasable holder means comprising releasable holder elements;

said releasable holder means being releasably engageable with the container for maintaining the container in a suspended position during said filling of the container with the textile material in the form of said sliver loops; and the container having an elevationally displaceable container floor.

4. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section and a longitudinal direction of extent;

means for imparting to the container a to-and-fro movement in the longitudinal direction of extent of the container;

said movement imparting means comprising displacement means and releasable holder means secured to said displacement means;

said releasable holder means being releasably engageable with the container for maintaining the container in a suspended position during said filling of the container with the textile material in the form of said sliver loops;

the container having an elevationally displaceable container floor; and an external elevationally positioning device for selectively elevationally positioning the displaceable container floor.

5. The apparatus as defined in claim 4, further including:

control means provided for the elevation positioning device for controlling at least the velocity of the elevational movement of the displaceable container floor.

6. The apparatus as defined in claim 4, further including:

control means provided for the elevation positioning device for setting at least a predetermined lifting force of the displaceable container floor.

7. The apparatus as defined in claim 4, further including:

control means provided for the elevation positioning device for controlling the velocity of the elevational movement of the displaceable container floor and for setting a predetermined lifting force of the displaceable container floor.

8. The apparatus as defined in claim 4, wherein: said elevation positioning device comprises:

an adjustable scissor-like mechanism positionable beneath the displaceable container floor; and means for driving the adjustable scissor-like mechanism.

9. The apparatus as defined in claim 8, wherein:

said adjustable scissor-like mechanism comprises gear means rotatably mounted at the adjustable scissor-like mechanism; and said driving means comprising:

a worm shaft engaging with said gear means; and an electric motor for driving said worm shaft.

10. The apparatus as defined n claim 4, further including:

container entrainment means operatively connectable with the container; and said external elevation positioning device being mounted at said container entrainment means.

11. The apparatus as defined in claim 10, wherein:

said container entrainment means comprise:

a carriage movable beneath the container; and coupling elements provided for the carriage and engageable with the container.

12. The apparatus as defined in claim 11, wherein:

said coupling elements comprise pivotable gripper arms movable into a predetermined path of displacement of the container.

13. The apparatus as defined in claim 11, further including:

a displacement device provided for the carriage selectively coupled with said carriage.

14. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section and a longitudinal direction of extent;

means for imparting to the container a to-and-fro movement in the longitudinal direction of extent of the container;

said movement imparting means comprising displacement means and releasable holder means secured to said displacement means;

said releasable holder means being releasably engageable with the container for maintaining the container in a suspended position during said filling of the container with the textile material in the form of said sliver loops;

the container having an elevationally displaceable container floor;

means defining at least one container deposit position for filled containers located to one side of a container located in a textile material filling position in the longitudinal direction of extent of such container; and means defining at least one container deposit position for empty containers located to an opposite side of the container located in the textile material filling position in the longitudinal direction of extent of such container.

15. The apparatus as defined in claim 14, further including:

an infeed device for empty containers provided for said at least one container deposit position for empty containers for infeeding empty containers to said at least one container deposit position; and a removal device for full containers provided for said at least one container deposit position for full containers for removing the filled containers from said at least one container deposit position for full containers.

16. The apparatus as defined in claim 14, further including:

a container monitoring sensor provided for at least any one of said container deposit position for empty containers and said container deposit position for full containers.

17. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section and a longitudinal direction of extent;

means for imparting to the container a to-and-fro movement in the longitudinal direction of extent of the container;

said movement imparting means comprising displacement means and releasable holder means secured to said displacement means;

said releasable holder means being releasably engageable with the container for maintaining the container in a suspended position during said filling of the container with the textile material in the form of said sliver loops;

means defining at least one container deposit position for filled containers located to one side of a container located in a textile material filling position in the longitudinal direction of extent of such container;

means defining at least one container deposit position for empty containers located to an opposite side of the container located in the textile material filling position in the longitudinal direction of extent of such container; and sliver severing means located at the region of the container deposit position for the filled containers.

18. The apparatus as defined in claim 17, wherein:

said sliver severing means comprise a pivotable clamping ledge which during a clamping and severing operation on the sliver, engages with a surface of a gripper situated closest to the funnel wheel.

19. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section and a longitudinal direction of extent;

means for imparting to the container a to-and-fro movement in the longitudinal direction of extent of the container;

said movement imparting means comprising first displacement means and releasable holder means secured to said first displacement means;

said releasable holder means being releasably engageable with the container for mainlining the container in a suspended position during said filling of the container with the textile material in the form of said sliver loops;

the container having an elevationally displaceable container floor;

each container has a pair of narrow sides;

said displacement means comprising a respective displacement device located adjacent each narrow side of the container;

each said displacement device being provided with releasable holder means comprising releasable holder elements;

an external elevation positioning device for selectively elevationally positioning the displaceable container floor;

a textile material-delivering machine for delivering slivers to the funnel wheel;

a funnel wheel drive for the funnel wheel;

second displacement means for the infeed of empty containers;

third displacement means for the outfeed of full containers; and central control means for controlling the textile material-delivering machine, the funnel wheel drive, the first displacement means for the container, the second displacement means for the infeed of the empty containers, the third displacement means for the outfeed of the full containers, and the elevation positioning device for the movable container floor.

20. The apparatus as defined in claim 19, wherein:

said textile material-delivery machine comprises a draw frame.

21. A method of filling containers having an elongate cross-section and a longitudinal direction of extent with sliver-like textile material, comprising the steps of:

suspending a container, having an elevationally movable container floor, to be filled with sliver-like textile material in spaced relationship from a mill floor;

depositing loops of said sliver-like textile material into the container having the elevationally movable container floor in order to fill the container;

moving the container to-and-fro in the longitudinal direction of extent thereof during the filling operation while in the suspended condition spaced from the mill floor;

displacing the elevationally movable container floor from externally of the container by an elevation positioning device during filling of the container with the sliver-like textile material; and entraining the elevation positioning device at the container by coupling means during the to-and-fro movement of the container.

22. The method as defined in claim 21, further including the steps of:

providing a coiler accomplishing the depositing of the loops of sliver-like material into the container; and controlling the velocity of the to-and-fro movement of the container as a function of the position of the coiler with respect tot a narrow side of the to-and-fro moving container which is being filled with the sliver-like textile material.

23. The method as defined in claim 22, wherein the step of:

controlling the velocity of the to-and-fro movement of the container entails briefly increasing the velocity of the to-and-fro movement of the container shortly prior to reaching a movement reversal location of the to-and-fro moving container and after the container has moved through the movement reversal location returning the velocity of the to-and-fro movement of the container to a predetermined to-and-fro movement velocity.

24. The method as defined in claim 25, further including the steps of:

decoupling the elevation positioning device from the container prior to deposition of a last filling layer of said sliver-like material into the container;

transferring the decoupled elevation positioning device to an empty container located in a suspended preparatory position; and coupling the elevation positioning device by means of the coupling means with the empty container located in the suspended preparatory position.

25. The method as defined in claim 24, further including the steps of:

displacing the container which has been filled with the sliver-like textile material, upon completion of the filling thereof, by means of a displacement device out of a container filling position at a filling station., and substantially simultaneously with the displacement of the container out of the container filling position at the filling station, displacing the empty container coupled with the elevation positioning device from the suspended preparatory position by means of a further displacement device to the container filling position at the filling station which was previously occupied by the container filled with sliver-like textile material.

26. The method as defined in claim 25, wherein:

the step of displacing the container which has been filled with the sliver-like textile material by means of the displacement device out of the container filling position at the filling station entails transferring the filled container to a deposit location;

releasing holding elements of the displacement device for the filled container in order to deposit the filled container at the deposit location;

transferring the displacement device with the holding elements located in a retracted position to the location of an empty container held in readiness; and engaging the empty container held in readiness by means of the holding elements of the displacement device.

27. The method as defined in claim 25, further including the step of:

clamping the sliver-like textile material between the filled container which has been displaced out of the container filling position and the empty container which has been displaced into the container filling position.

28. The method as defined in claim 21, wherein the step of:

moving the container to-and-fro in the longitudinal direction of extent thereof during the filling operation while in the suspended conditions spaced from the mill floor includes reversing the to-and-fro movement of the container at movement reversal locations; and displacing the container to be filled with the sliver-like textile material during the filling operation by a predetermined and adjustable amount in a direction transverse to the direction of the to-and-fro movement of the container following each movement reversal of the container.

29. The method as defined in claim 28, wherein the step of displacing the container in a direction transverse to the direction of the to-and-fro movement of the container entails tilting the container.

30. The method as defined in claim 21, further including the step of:

adjusting the magnitude of the to-and-fro movement of the container as a function of the degree of filling of the container with the sliver-like textile material.

31. The method as defined in claim 30, wherein:

the step of moving the container to-and-fro in the longitudinal direction of extent thereof includes reversing the to-and-fro movement of the container at movement reversal location such that the container is successivley moved to-and-fro in opposite directions of movement; and performing the step of adjusting the magnitude of the to-and-fro movement of the container as a function of the degree of filling of the container with the sliver-like textile material such that with each lengthwise movement of the to-and-fro moving container in one of the opposite directions of movement there is reduced the displacement path of the container from a narrow side of the container by an amount corresponding to at least the thickness of the sliver-like textile material.

32. The method as defined in claim 21, further including the step of:

automatically exchanging the container to be filled and located in a container filling position, upon interruption of the delivery of the sliver-like textile material, for an empty container located in a preparatory position.

33. The method as defined in claim 21, further including the step of:

transferring the automatically exchanged container to a predetermined receiving station.

34. An apparatus for filling textile material into a container having an elongate cross-section and a longitudinal direction of extent, comprising:

a stationary and rotatably driven funnel wheel for delivering said textile material in the form of a sliver for deposition of said sliver in the form of sliver loops into said container having an elongate cross-section and a longitudinal direction of extent;

means for imparting to the container a reciprocating movement in the longitudinal direction of extent of the container;

said movement imparting means comprising displacement means and releasable holder means secured to said displacement means;

said releasable holder means comprise holder elements comprising grippers;

means for mounting said grippers for pivotal movement about upright axes;

said grippers being located at said displacement means to operate in coacting gripper pairs;

said mounting means pivotably mounting said gripper pairs for movement between a first position where said gripper pairs extend substantially transverse to he longitudinal direction of extent of the container and a second position where said gripper pairs extend substantially in the longitudinal direction of extent of the container; and said releasable holder means being releasably engageable with the container for maintaining the container in a suspended position during said filling of the container with the textile material in the form of said sliver loops.

35. The apparatus as defined in claim 34, wherein:

the container has an elevationally displaceable container floor.

36. A method of filling containers having an elongate cross-section and a longitudinal direction of extent with sliver-like textile material, comprising the steps of;

engaging a container having an equationally movable container floor and which is to be filled with sliver-like textile material by pivotably mounted gripper pairs which are movable between a first position where said gripper pairs extend substantially transverse to the longitudinal direction of extent of the container and a second position where said gripper pairs extend substantially in the longitudinal direction of extent of the container;

during engagement of the container the gripper pairs extending substantially transverse to the longitudinal direction of extent of the container;

suspending the obtainer, having the elevationally movable container floor, in spaced relationship from a mill floor;

depositing loops of said sliver-like textile material into the container having the elevationally movable container floor in order to fill the container;

reciprocatingly moving the container in the longitudinal direction of extent thereof during the filling operation while in the suspended condition spaced from the mill floor;

displacing the elevationally movable container floor from externally of the container by an elevation positioning device during filling of the container with the sliver-like textile material; and entraining the elevation positioning device at the container by coupling means during reciprocating movement of the container.

37. The method as defined in claim 36, further including the step of:

after filling the container with the sliver-like textile material decoupling the coupling means in order to release the elevation positioning device from the container;

shifting the elevation positioning device to a location remote from the filled container;

displacing the gripper pairs away from the container to release the filed container;

removing the filled container to a filled container deposit location; and displacing the gripper pairs inwardly into the second position where said gripper pairs extend substantially in the longitudinal direction of extent of the container and locating the gripper pairs at a predetermined location for subsequent engagement with an empty container having an elevationally movable container floor and which is to be filled with sliver-like textile material.

* * * * *